US005210123A

United States Patent [19]

Caporiccio

[11] Patent Number: 5,210,123

[45] Date of Patent: May 11, 1993

[54] GREASE COMPOSITIONS EMPLOYING A VINYLIDENE FLUORIDE-HEXAFLUOROISOBUTYLENE COPOLYMER THICKENING AGENT

[75] Inventor: Gerardo Caporiccio, Midland, Mich.

[73] Assignee: Dow Corning Corporation, Midland, Mich.

[21] Appl. No.: 590,731

[22] Filed: Oct. 1, 1990

[51] Int. Cl.[5] ..... C08J 5/24

[52] U.S. Cl. ..... 524/263; 524/366; 524/462; 524/463; 524/464; 524/545; 524/546

[58] Field of Search ..... 524/263, 366, 462, 463, 524/464, 545, 546

[56] References Cited

U.S. PATENT DOCUMENTS 3,706,723 12/1972 Chandrasekaran et al. ..... 260/87.7

OTHER PUBLICATIONS

CM-X-"A New Fluoropolymer With Unique Mechanical Properties" by A. B. Robertson, S. Chandrasekaran, C. S. Chen; Ausimont U.S.A., Inc., Morristown, N.J.; pp. 1-15.

Plastics Manuf. vol. 88, 1978—p. 21.

Plastics Manuf. vol. 86, 1977—p. 19.

*Primary Examiner*—Joseph L. Schofer

*Assistant Examiner*—Peter D. Mulcahy

*Attorney, Agent, or Firm*—Alexander Weitz

[57] ABSTRACT

A vinylidene fluoride-hexafluoroisobutylene copolymer powder is employed to thicken a conventional fluorine-containing liquid lubricant to provide a grease composition which has improved lubrication character in metal bearing subjected to the simultaneous conditions of high load, high speed and elevated temperature.

16 Claims, No Drawings

GREASE COMPOSITIONS EMPLOYING A VINYLIDENE FLUORIDE-HEXAFLUOROISOBUTYLENE COPOLYMER THICKENING AGENT

The present invention relates to lubricating grease compositions. More particularly, the invention relates to greases suitable for extreme pressure lubrication applications wherein a thickening agent comprising a vinylidene fluoridehexafluoroisobutylene copolymer powder is uniformly dispersed in a fluorine-containing liquid lubricant.

BACKGROUND OF THE INVENTION

It is widely known that powdered polytetrafluoroethylene polymer can act as a thickening agent for a liquid lubricant, such as a perfluoropolyether or fluorosilicone, to produce a lubricant having a grease consistency. Such grease compositions exhibits relatively good lubricating properties for bearings operating at high load and low speed. However, under certain extreme pressure conditions, which also require the bearing to operate at high speeds and high temperatures, use of this type of grease often results in relatively short bearing life. Such heavy duty service is typically experienced, for example, by bearings in conveyor chain used in the manufacture of metals and electric bulbs and in machinery used in the production of coiled metal, textiles and paper. Therefore, these applications provide continuing motivation for those skilled in the art to develop grease formulations which offer improved load resistance, thermal resistance, resistance to wear, low friction and a wide temperature range of application.

SUMMARY OF THE INVENTION

It has now been found that a grease composition comprising a homogeneous dispersion of a vinylidene fluoridehexafluoroisobutylene (i.e., 1,1-difluoroethylene-3,3,3-trifluoro-2-trifluoromethyl propene) copolymer powder in a fluorocarbon liquid lubricant provides unexpectedly superior lubrication for metal bearings operating under the simultaneous conditions of high load, high speed and elevated temperature. Specifically, stable grease compositions of the invention have been shown to provide at least about a two to five fold increase in bearing longevity, as determined by a standard wear test procedure, when compared with similar grease compositions employing a conventional polytetrafluoroethylene thickening agent. The present invention therefore relates to a grease composition comprising:

(I) from about 7 to about 35 parts by weight of a thickening agent comprising a vinylidene fluoride-hexafluoroisobutylene copolymer powder having a molar ratio of vinylidene fluoride monomer units to hexafluoroisobutylene monomer units of about 1:1, said thickening agent being uniformly dispersed in (II) from about 93 to about 65 parts by weight of a liquid lubricant selected from the group consisting of (i) a telomer of chlorotrifluoroethylene having a viscosity from about 10 to about 1,000 cS at 40° C.;

(ii) a fluorosilicone copolymer having a viscosity from about 30 to about 10,000 cS at 25° C.; and (iii) a perfluoropolyether having a viscosity from about 30 to about 10,000 cS at 20° C.

DETAILED DESCRIPTION OF THE INVENTION

The present invention relates to a grease composition comprising a uniform dispersion of a particular fluorocarbon copolymer thickening agent (I) in a liquid fluorocarbon lubricant (II).

The thickening agent (I) comprises a vinylidene fluoride-hexafluoroisobutylene copolymer powder having a molar ratio of alternating vinylidene fluoride mer units to hexafluoroisobutylene mer units of about 1:1. The number average molecular weight of this copolymer should at least about 50,000 and the melting point is preferably above 300° C. For the purposes of the present invention, this copolymer powder should have an average particle size between about 2 and about 100 microns, preferably between 5 and 50 microns.

The vinylidene fluoride-hexafluoroisobutylene copolymer is well known in the art and may be prepared, for example, by methods outlined in U.S. Pat. No. 3,706,723 to Chandrasekaran et al. It is also available commercially from Ausimont U.S.A., Inc. (Morristown, NJ) under the trade name CM-X FLUOROPOLYMER.

Component (I), in addition to the vinylidene fluoride-hexafluoroisobutylene copolymer powder, may comprise up to about 95 weight percent of a conventional thickening agent based on polytetrafluoethylene (PTFE) or copolymers thereof. The latter may be selected from copolymers of tetrafluoroethylene and up to about 25 weight percent of hexafluoropropylene or copolymers of tetrafluoroethylene and up to about 15 weight percent of perfluoropropylvinyl ether. Such conventional fluorine-containing thickening agents, when added to component (I), can be used to modify the softness as well as load and impact resistance of the resulting grease. Furthermore, their presence can reduce particle aggregation under load.

An example of the PTFE which may be used as the above mentioned conventional thickening agent which may be included in component (I) is a series of products marketed under the trade name VYDAX TM by E. I. du Pont (Wilmington, DE). Such polymers may be produced by polymerization of tetrafluoroethylene in the presence of chain transfer agents, such as $CCl_4$, and typically have number average molecular weights up to about 100,000, preferably up to about 50,000. Polymers of this type may be obtained as a dispersion in a fluorocarbon solvent, such as FREON TM F113, or in dry powder form.

Another example of commercial PTFE suitable herein is the polymer obtained by thermal or gamma ray degradation of high molecular weight PTFE or mechanical grinding thereof. Such polymers typically have number average molecular weights in the order of $10^4$ to $10^6$.

Yet another example of commercial PTFE which may be included in component (I) is obtained by emulsion polymerization and subsequent precipitation so as to provide a fine powder. Aggregates of the powder can be readily broken down by passing a liquid suspension of the powder through a two- or three-roll mill. Specific examples of this type of PTFE micro-powder are manufactured by I.C.I. (England), Hoechst (W. Germany) and L.N.P. (Malvern, PA.).

For further descriptions of the above mentioned polymers and copolymers of PTFE, and methods for preparing them, the interested reader is directed to, e.g., the *Encyclopedia of Polymer Science and Engineering* (H. F. Mark et al., Editors), Vol. 16, p. 577-648, J. Wiley & Sons (1989).

Grease compositions of the invention are prepared by uniformly dispersing the above described thickening agent (I) in a liquid lubricant (II) selected from fluorine-containing compounds (i) through (iii), described infra.

Component (i) is a liquid telomer of chlorotrifluoroethylene having a viscosity from 10 to 1,000 cS at 40° C. These weight compounds are known in the art and have the general structure $CX_3(C_2F_3Cl)_nX'$ or $Cl(C_2F_3Cl)_nCl$, in which X and X' are independently selected from fluorine or chlorine, with the proviso that at least one X is chlorine, and n is sufficient to impart the above viscosity range at 40° C. Liquid telomers of this type are produced commercially by Halocarbon Products Corp. (Hackensack, N.J.) and Atochem (France).

Component (ii) is a liquid fluorosilicone having a viscosity from about 30 to about 10,000 cS at 25° C. and can be a homopolymer of siloxane units represented by the formula (a)

$$R_F(CH_2)_nSiO(R)- \quad (a)$$

or a copolymer of these siloxane units with siloxane units represented by the formula (b)

$$CH_3SiO(R')- \quad (b)$$

In the above formulas, $R_F$ is a perfluoroalkyl radical having 1 to 8 carbon atoms, n is an integer between 1 and 3, R is a monovalent hydrocarbon radical selected from the group consisting of an alkyl radical having 1 to 6 carbon atoms, a cyclohexyl group and a phenyl group and R' is a monovalent hydrocarbon radical selected from the group consisting of methyl, phenyl and chlorophenyl. When fluorosilicone (ii) contains siloxane units (b), no more than about 50 mole percent of the (b) should be present. Preferably, component (ii) is the homopolymer consisting essentially of the (a) siloxane units having a viscosity of about 300 to 2,000 cS at 25° C. For the purpose of the present invention, the terminal groups of fluorosilicone (ii) are not critical and can be such groups as trimethylsiloxy, dimethylphenylsiloxy or dimethyltrifluoropropylsiloxy, inter alia. The fluorosilicone polymers and copolymers are well known in the art and some are available commercially from, e.g., Dow Corning Corp. (Midland, MI.).

Component (iii) is a liquid perfluoropolyether having a viscosity from about 30 to about 10,000 cS at 20° C. The perfluoropolyethers which may be used as the liquid lubricant (II) of the invention are well known in the art and may be illustrated by the general average structures shown in formulas (c) through (g).

$$R'_FO-(CF_2-CF(CF_3)O)_p-R'_F \quad (c)$$

$$R'_FO-(CF_2-CF(CF_3)O)_q-(CF_2O)_r-R'_F \quad (d)$$

-continued $$R'_FO(C_2F_4O)_s(CF_2O)_t-R'_F \quad (e)$$

$$R'_FO(CF_2CF_2CF_2O)_v-R'_F \quad (f)$$

$$R'_FO(CF_2CF(CF_3)O)_{q'}(CF_2CF_2O)_{s'}(CF_2O)_{r'}-R'_F \quad (g)$$

In formulas (c) through (g), $R'_F$ is an independently selected perfluoroalkyl radical having 1 to 3 carbon atoms (i.e., $-CF_3$, $-CF_2CF_3$ or $-C_3F_7$). The values of the subscripts p, q, r, s, t, v, q', s' and r' are such as to place the viscosity of the above perfluoropolyethers (c) through (g) within the above stated range of about 30 to about 10,000 cS at 20° C., with the further proviso that the ratio q/r is between 10 and 1,000, the ratio s/t is between 0.5 and 20 and the ratio (q'+s')/r' is between 0.5 and 20.

All of the above perfluoropolyethers are known in the art and some are available commercially. Thus, for example, structures of the type shown in formula (c) are available from E. I. du Pont (Wilmington, DE), structures (d), (e) and (g) can be produced according to the methods disclosed in British patent GB 1,104,482, Italian patent IT 933,753 and European Patent Applications EP 0344547 and EP 0340793 to Ausimont S. r.l. and structures of the type shown in formula (f) are available from Daikin (Japan) (see, e.g., EP 0148,482). It is preferred that component (iii) has the above formula (d), wherein $R'_F$ is independently selected from the group consisting of $-CF_3$ and $-CF_2CF_3$, the ratio q/r is about 50 and the values of q and r are such that the viscosity of said perfluoropolyether is about 200 to 2,000 cS at 20° C.

In general, the liquid lubricant (II) is selected from one of the compounds (i) through (iii). However, about 2 to 5 weight percent of telomer (i) having the proper viscosity can be blended with one of the perfluoropolyethers (iii) to form component (II). It is also to be pointed out that the respective viscosity ranges of each liquid lubricant described above should be adhered to in order to realize the benefits of the present compositions. Thus, when the viscosity of the fluid falls below this range, the resulting composition is too "runny" and not suitable for use as a grease. Similarly, when the fluid viscosity is above the range, the grease is too stiff and leads to application difficulties.

The basic compositions of the present invention contain about 7 to about 35 parts by weight of the thickening agent (I) and about 93 to about 65 parts by weight of the liquid lubricant (II) for each 100 parts of grease. These basic formulations may, however, be modified by the addition of other components commonly employed in the art, such as dispersing or wetting agents, antiwear agents and protective agents for metals.

An example of a suitable surfactant is the class of perfluorinated neutral salts represented by the general formula $R_FAM$, wherein $R_F$ has its above defined meaning, A is a monovalent anionic group selected from $-SO_3^-$ or $-COO^-$ and M is a cation, such as $Na^+$ and $K^+$. Specific examples include $C_7F_{15}COONa$ and $C_8F_{17}SO_3K$. The surfactant, which is generally employed to improve the stability of the grease with respect to phase separation, is typically added in a proportion of about 0.1 to 1% of the weight of the thickening agent (I).

Examples of antirusts or metal protecting agents include the following compositions which help protect metal bearing surfaces exposed to aggressive environments:

(1) mixtures of $NaNO_2$, $NaNO_3$ and MgO in a ratio of 2 to 20 parts by weight of $NaNO_2$ for 1 part of $NaNO_3$ and 1 part by weight of MgO per 10 to 50 parts of the sodium salts. These mixtures are typically added in a proportion of about 0.01 to 5 parts by weight per 100 parts of the thickening agent (I).

(2) mixtures of 0.1 to 3 parts by weight of benzotriazole and 0.05 to 5 parts of MgO (optionally in the presence of 0.05 to 1.5 parts by weight of KOH) per 100 parts of thickening agent (I).

(3) 1 to 2 parts by weight of the barium or zinc salt of an dialkylnaphthalenesulfonic acid, such as dinonylnaphthalenesulfonic acid or dodecylnaphthalenesulfonic acid, per 100 parts of thickening agent (I).

(4) 0.2 to 2 parts by weight of triphenylphosphine, or tripentafluorophenylphosphine, per 100 parts of the thickening agent (I).

(5) 1 to 10 parts by weight of $MOS_2$ as antiwear agent per 100 parts of thickening agent (I).

(6) 0.5 to 1 part by weight of a heat stabilizer such as an oxide of zinc or calcium or magnesium per 100 parts of thickening agent (I).

Compositions of the invention may be prepared according to well known methods used in the art to manufacture conventional polytetrafluoroethylene-thickened greases. Thus, for example, the thickening agent (I), optionally containing the conventional thickening agent based on polytetrafluoroethylene or copolymers thereof, may be mixed with one or more of the above described additives (if desired) in a low shear mixer, such as a two Z-blade mixer, preferably under vacuum. After any additives employed are well mixed with the thickening agent, the liquid lubricant component is introduced and a homogeneous dispersion obtained by mixing these components at temperatures of about 50° to 180° C. The resulting grease is preferably further processed in a three-roll mill to reduce the size of the aggregates and improve the suspension, thus providing a more stable formulation.

The grease compositions of the present invention exhibit exceptionally good resistance to fatigue and high load-carrying capacity when used to lubricate metal bearings subjected to sliding, oscillatory or rotational motion. These compositions thus find particular utility in bearings subjected to high loads, high speed or to an extraordinary degree of vibration. Moreover, the greases of the invention show high resistance to high temperature and operate effectively in oxidative or chemically aggressive environments.

EXAMPLES

The following examples are presented to further illustrate the compositions of this invention, but are not to be construed as limiting the invention, which is delineated in the appended claims. All parts and percentages in the examples are on a weight basis and all measurements were obtained at 25° C., unless indicated to the contrary.

EXAMPLE 1

Into a jacketed 1 liter mixer equipped with two Z-shaped mixing blades and ports for the introduction of liquids and for the removal of air or volatile components, there was charged 1 part of benzotriazole, 2 parts of MgO and 20 parts of CM-X FLUOROPOLYMER, the latter being obtained from Ausimont U.S.A., Inc. (Morristown, NJ). These contents were mixed while the jacket was heated at 50° C. and one of the vessel's ports was connected to a vacuum to remove air from the voids of the polymer powder. To this mixture, there was added, over a two hour period, 80 parts of a perfluoropolyether liquid having the average formula $$R'_FO-(CF_2-\underset{\underset{CF_3}{|}}{CFO})_q-(CF_2O)_r-R'_F$$

wherein the end groups $R'_F$ include mainly $-CF_3$ and $-CF_2CF_3$ radicals, the ratio q/r is 50 and the value of the sum of q and r is such that the viscosity of the liquid was about 1,500 cS at 20° C. The resulting mixture was stirred for another 8 hours at 50° C. and then for 3 hours as the temperature was increased from 50° C. to 180° C. The mixture was then allowed to cool to room temperature and a stable grease was obtained. The grease was then passed twice through a three-roll mill with a gap setting of about 4–6 microns. The final grease was determined to have a consistency corresponding to a National Lubricants and Grease Institute (NLGI) degree 2, as determined by a modified ASTM D1403 penetration test method. Oil separation of the grease, at 204° C./30 hours, was approximately 15% according to United States Federal Test Method Standard FTMS 791-321.

The above grease was subjected to a 4-ball extreme pressure test (1460 rpm, 1 min) and showed a welding load of 4,800 N.

In another lubricity test, carried out at 200° C. by the National Center of Tribology (N.C.T.) of Risley (England), ball bearings lubricated with the above grease were mounted on a shaft which was rotated at 3,000 rpm and had an applied axial load of 200 N. After 1,000 hours, there was no indication of failure and neither visible damage of any kind nor any increase in noise of operation could be detected.

The N.C.T. also tested the grease using a FALEX Machine at 290 rpm/100° C., which showed a failure load of 1,6000 pounds.

A sample of the above grease was used to lubricate ball bearings (type 6205 steel, 50 mm inner diameter bearings) and the bearings were tested according to FAG FE 9 method (DIN 51821) at 3.000 rpm at 230° C. under a 1,500 N load. The bearings showed no damage upon visual inspection after 600 hours of operation. By comparison, two similar commercial grease formulations, based on polytetrafluoroethylene thickening agent and a perfluoropolyether liquid lubricant, resulted in failure (i.e., readily observable bearing damage) after only 250 and 130 hours of operation, respectively, under identical FAG FE 9 test conditions.

EXAMPLE 2

The mixer described in Example 1 was used to produce a grease composition of the invention wherein 10 parts of the CM-X FLUOROPOLYMER and 10 parts polytetrafluoroethylene (PTFE) powder comprised the thickening agent. The PTFE was introduced in the form of a dispersion in a fluorocarbon solvent (VYDAX TM 1000; E. I. du Pont; Wilmington, DE), 145 parts of this dispersion corresponding to the 10 parts of PTFE employed. After charging the mixer with the above ingredients, 80 parts of the perfluoropolyether liquid used in Example 1 were added over a period of 4 hours. When 20 parts of liquid had been added, the mixer jacket was heated at 50° C. and the FREON TM 113, contained in the VYDAX TM 1000 as suspending phase, was evaporated under vacuum. Heat and vacuum were maintained until all the liquid perfluoropolyether was added, whereupon the contents were further mixed under vacuum for 10 hours at temperatures from 50° C. to 100° C. and then for 1 hour at temperatures from 100° C. to 180° C. The resulting grease was cooled while stirring and had a penetration value in the range of NLGI degree 2, an evaporation loss of 0.9% at 204° C./30 hours and an oil separation of 14% according to the aforementioned ASTM method.

EXAMPLE 3

Following the procedure reported in Example 1, a grease with a penetration grade of NLGI 2 was obtained by mixing 28 parts of the CM-X FLUOROPOLYMER with 69 parts of a trimethysiloxy-terminated methyl-3,3,3-trifluoropropylpolysiloxane fluid having a viscosity of about 1,000 cS at 25° C., 1 part of benzotriazole and 2 parts of MgO powder. The grease was tested on the FALEX machine at 100° C./290 rpm and a failure load of 1,200 pounds was determined.

That which is claimed is:

1. A grease composition comprising:

(I) 7 to about 35 parts by weight of a thickening agent comprising a vinylidene fluoridehexafluoroisobutylene copolymer powder having a molar ratio of vinylidene fluoride mer units to hexafluoroisobutylene mer units of about 1:1, said thickening agent being uniformly dispersed in (II) 93 to about 65 parts by weight of a liquid lubricant selected from the group consisting of (i) a telomer of chlorotrifluoroethylene having a viscosity of 10 to 1,000 cS at 40° C.;

(ii) a fluorosilicone copolymer having a viscosity of 30 to 10,000 cS at 25° C.; and (iii) a perfluoropolyether having a viscosity of 30 to 10,000 cS at 20° C.

2. The composition according to claim 1, wherein said fluorosilicone (ii) is selected from the group consisting of a homopolymer of siloxane units represented by the formula $$R_F(CH_2)_nSiO(R)- \quad (a)$$

and a copolymer of said siloxane units (a) with siloxane units represented by the formula $$CH_3SiO(R')- \quad (b)$$

wherein $R_F$ is a perfluoroalkyl radical having 1 to 8 carbon atoms, n is an integer between 1 and 3, R is a monovalent hydrocarbon radical selected from the group consisting of an alkyl radical having 1 to 6 carbon atoms, a cyclohexyl group and a phenyl group and R' is a monovalent hydrocarbon radical selected from the group consisting of methyl, phenyl and chlorophenyl, no more than about 50 mole percent of the total siloxane units being those represented by formula (b).

3. The composition according to claim 2, wherein $R_F$ of said siloxane unit (a) is $-CF_3$.

4. The composition according to claim 3, wherein R' of said siloxane unit (b) is a methyl radical.

5. The composition according to claim 4, wherein n of said siloxane unit (a) is 2.

6. The composition according to claim 5, wherein said fluorosilicone (ii) is methyl-3,3,3-trifluoropropylpolysiloxane having a viscosity of 300 to 2,000 cS at 25° C.

7. The composition according to claim 1, wherein said perfluoropolyether (iii) is selected from the group consisting of compounds represented by the average structures $$R'_FO-(CF_2-CF(CF_3)O)_p-R'_F \quad (c)$$

$$R'_FO-(CF_2-CF(CF_3)O)_q-(CF_2O)_r-R'_F \quad (d)$$

$$R'_FO(C_2F_4O)_s(CF_2O)_t-R'_F \quad (e)$$

$$R'_FO(CF_2CF_2CF_2O)_v-R'_F \quad (f)$$

and $$R'_FO(CF_2CF(CF_3)O)_{q'}(CF_2CF_2O)_{s'}(CF_2O)_{r'}-R'_F \quad (g)$$

wherein $R'_F$ is an independently selected perfluoroalkyl radical having 1 to 3 carbon atoms, and the values of p, q, r, s, t, v, q', s' and r' are such as to place the viscosity of said perfluoropolyethers (c) through (g) within the range of 30 to 10,000 cS at 20° C., with the further proviso that the ratio q/r in formula (d) is between 10 and 1,000, the ratio s/t in formula (e) is between 0.5 and 20 and the ratio (q'+s')/r' in formula (g) is between 0.5 and 20.

8. The composition according to claim 7, wherein said perfluoropolyether (iii) has the average structure $$R'_FO-(CF_2-CF(CF_3)O)_q-(CF_2O)_r-R'_F$$

wherein $R'_F$ is independently selected from the group consisting of $-CF_3$ and $-CF_2CF_3$, the ratio q/r is 50 and the values of q and r are such that the viscosity of said perfluoropolyether is 200 to 2,000 cS at 20° C.

9. The composition according to claim 1, wherein said thicknening agent (I) further comprises up to 95 weight percent of a fluorine-containing polymeric material selected from the group consisting of (A) polytetrafluoroethylene, (B) a copolymer of tetrafluoroethylene and up to 25 weight percent of hexafluoropropylene and (C) a copolymer of tetrafluoroethylene and up to 15 weight percent of perfluoropropylvinyl ether.

10. The composition according to claim 9, wherein said fluorosilicone (ii) is selected from the group consisting of a homopolymer of siloxane units represented by the formula $$R_F(CH_2)_nSiO(R)- \quad (a)$$

and a copolymer of said siloxane units (a) with siloxane units represented by the formula $$CH_3\overset{|}{\underset{R'}{Si}}O- \quad (b)$$

wherein $R_F$ is a perfluoroalkyl radical having 1 to 8 carbon atoms, n is an integer between 1 and 3, R is a monovalent hydrocarbon radical selected from the group consisting of an alkyl radical having 1 to 6 carbon atoms, a cyclohexyl group and a phenyl group and R' is a monovalent hydrocarbon radical selected from the group consisting of methyl, phenyl and chlorophenyl, no more than 50 mole percent of the total siloxane units being those represented by formula (b).

11. The composition according to claim 10, wherein $R_F$ of said siloxane unit (a) is $-CF_3$.

12. The composition according to claim 11, wherein R' of said siloxane unit (b) is a methyl radical.

13. The composition according to claim 12, wherein n of said siloxane unit (a) is 2.

14. The composition according to claim 13, wherein said fluorosilicone (ii) is methyl-3,3,3-trifluoropropylpolysiloxane having a viscosity of 300 to 2,000 cS at 25° C.

15. The composition according to claim 9, wherein said perfluoropolyether (iii) is selected from the group consisting of those represented by the average structures $$R'_FO-(CF_2-\underset{\underset{CF_3}{|}}{C}FO)_p-R'_F \quad (c)$$

-continued $$R'_FO-(CF_2-\underset{\underset{CF_3}{|}}{C}FO)_q-(CF_2O)_r-R'_F \quad (d)$$

$$R'_FO(C_2F_4O)_s(CF_2O)_t-R'_F \quad (e)$$

$$R'_FO(CF_2CF_2CF_2O)_v-R'_F \quad (f)$$

and $$R'_FO(CF_2\underset{\underset{CF_3}{|}}{C}FO)_{q'}(CF_2CF_2O)_{s'}(CF_2O)_{r'}-R'_F \quad (g)$$

wherein $R'_F$ is an independently selected perfluoroalkyl radical having 1 to 3 carbon atoms, and the values of p, q, r, s, t, v, q', s' and r' are such as to place the viscosity of said perfluoropolyethers (c) through (g) within the range of 30 to 10,000 cS at 20° C., with the further proviso that the ratio q/r in formula (d) is between 10 and 1,000, the ratio s/t in formula (e) is between 0.5 and 20 and the ratio (q'+s')/r' in formula (g) is between 0.5 and 20.

16. The composition according to claim 15, wherein said perfluoropolyether (iii) has the average structure $$R'_FO-(CF_2-\underset{\underset{CF_3}{|}}{C}FO)_q-(CF_2O)_r-R'_F$$

wherein $R'_F$ is independently selected from the group consisting of $-CF_3$ and $-CF_2CF_3$, the ratio q/r is about 50 and the values of q and r are such that the viscosity of said perfluoropolyether is 200 to 2,000 cS at 20° C.

* * * * *